United States Patent [19]

Lara

[11] Patent Number: 4,874,092

[45] Date of Patent: Oct. 17, 1989

[54] X-R CASE

[75] Inventor: Francisco J. Lara, Harlingen, Tex.

[73] Assignee: Ferrero & Wepfer, Harlingen, Tex.; a part interest

[21] Appl. No.: 218,921

[22] Filed: Jul. 14, 1988

[51] Int. Cl.[4] ..... B65D 27/00

[52] U.S. Cl. ..... 206/492; 229/68 C; 229/77; 229/125.38

[58] Field of Search ..... 206/491, 492; 229/1.5 R, 68 C, 77, 125.38

[56] References Cited

U.S. PATENT DOCUMENTS

| | | | |
|---|---|---|---|
| 1,026,933 | 5/1912 | Shreve | 229/77 |
| 1,864,069 | 6/1932 | Jones | 229/125.38 |
| 2,269,915 | 1/1942 | Porter | 229/125.38 |
| 4,244,511 | 1/1981 | Coleman | 206/492 |

FOREIGN PATENT DOCUMENTS

| | | | |
|---|---|---|---|
| 169313 | 9/1921 | United Kingdom | 229/125.38 |

*Primary Examiner*—Allen M. Ostrager

*Attorney, Agent, or Firm*—Fleit, Jacobson, Cohn, Price, Holman & Stern

[57] ABSTRACT

An elongated corrugated fiberboard panel assembly is provided with an elongated transverse longitudinal mid-portion fold zone dividing the panel assembly into opposite end panel sections which may be relatively angularly displaced between substantially coplanar open positions and closely juxtaposed parallel closed positions between which a panel to be protected such as an X-R film sheet may be received. The free swinging edges of the panel sections include transverse finger receivable slots which are registered when the panel sections are in the closed positions and the longitudinal mid-portions of a pair of attaching straps are anchored relative to the central area of one of the panel sections and the opposite ends of the straps are of sufficient length to extend transverse and longitudinally about the panel sections and have their opposite ends overlap engaged over the outer surface of the other panel sections, one of the end portions of the strap extending longitudinally about the panel sections passing through the finger receivable slots.

8 Claims, 1 Drawing Sheet

X-R CASE

BACKGROUND OF THE INVENTION

1. Field of the Invention

This invention relates to a case incorporating an elongated panel construction including hinge defining structure extending transversely of the panel construction centrally intermediate the opposite ends thereof dividing the panel assembly into a pair of opposite end panel sections which may be relatively angularly displaced between substantially coplanar open positions and closely juxtaposed parallel closed positions for safely and protectively receiving X-ray film sheet therebetween. Crossed strap structure is provided and supported from one of the panel sections and may be passed and secured about the case to retain the film sheets therein between the juxtaposed panel sections.

2. Description of Related Art

Various different forms of foldable case constructions heretofore have been provided for various purposes. Examples of these previously known forms of foldable cases are disclosed in U.S. Pat. Nos. 17,311; 204,872; 429,166; 649,816; 712,137; 745,251; 1,373,136 and 2,234,180. However, these previously known forms of cases do not include the overall combination of structural features incorporated in the instant invention.

SUMMARY OF THE INVENTION

The X-R case of the instant invention defines a case having relatively angularly displaceable front and back walls and one of the front and back walls supports the longitudinal mid-portions of a pair of crossed elongated fastening straps therefrom which may be passed and secured about the case, when closed, in order to retain the case in a closed position and X-R film sheets within the case. In addition, the front and rear walls of the case, adjacent the free swinging edges thereof, include finger receiving slots formed therethrough registered with each other when the case is closed and through which one end portion of one of the fastening straps may be passed.

The main object of this invention is to provide a case for safely storing and transporting panel members such as X-R film sheets.

Another object of this invention is to provide a case in accordance with the preceding object and which may be inexpensively produced.

Yet another object of this invention is to provide a case which may be readily manufactured in different sizes for containing different sized X-R film sheets.

Yet another object of this invention is to provide a case which may be constructed of various materials.

A final object of this invention to be specifically enumerated herein is to provide a case in accordance with the preceding objects and which will conform to conventional forms of the manufacture, be of simple construction and easy to use so as to provide a device that will be economically feasible, long-lasting and relatively troublefree in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
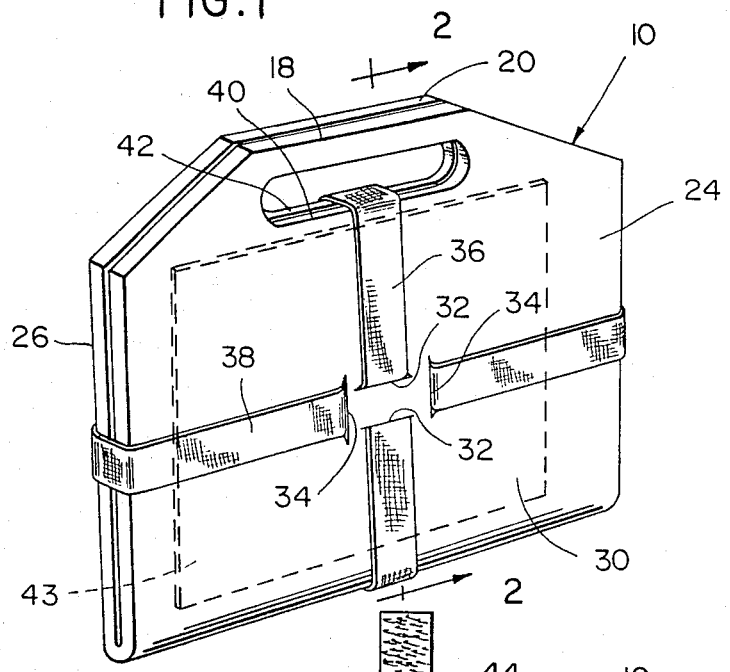
FIG. 1 is a perspective view of a case constructed in accordance with the present invention, the case being illustrated in the closed position thereof with the attendant crossed strap members passed and secured about the case and an X-R film sheet illustrated in phantom lines disposed between the front and rear panel sections of the case.

Referring now more specifically to the drawings, the numeral 10 generally designates the case of the instant invention. The case 10 incorporates an elongated panel construction referred in general by the reference numeral 12 constructed of corrugated fiberboard, although other materials including plastic may be used.

Figure 3:
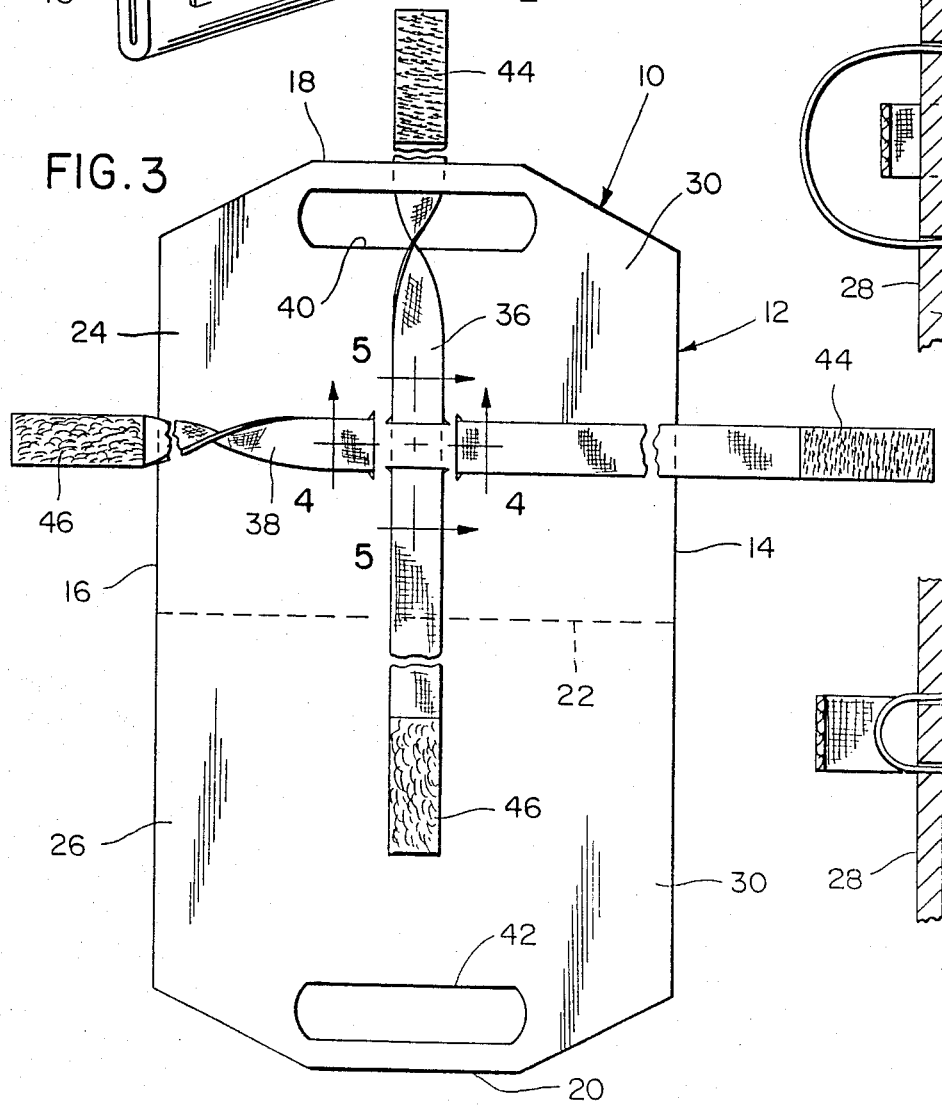
FIG. 3 is a plan view of the case in the open position.
Figure 5:
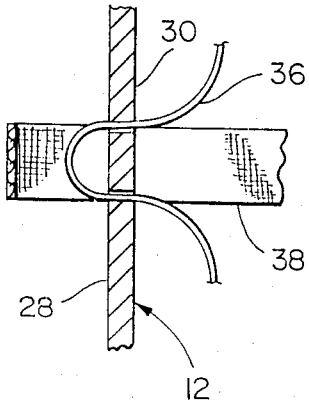
FIG. 5 is a fragmentary enlarged vertical sectional view taken substantially upon the plane indicated by the section line 5—5 of FIG. 3.

The panel construction 12 includes opposite side longitudinal edges 14 and 16 and opposite end transverse edges 18 and 20. Furthermore, the panel construction 12 includes a fold line or zone 22 extending transversely thereof centrally immediate the opposite end edges 18 and 20 and dividing the panel construction into a pair of opposite end panel sections 24 and 26. The fold zone 22 interconnects the panel sections 24 and 26 for relative angular displacement between the coplanar open positions thereof illustrated in FIG. 3 and closed closely juxtaposed positions such as those illustrated in FIG. 1. The panel sections 24 and 26 include inner sides 28 and outer sides 30, the inner sides 28 closely opposing each other and the outer sides 30 facing outwardly in opposite directions when the panel sections 24 and 26 are in their closed positions.

The panel section 24 includes a pair of laterally spaced apart parallel first slots 32 formed therein extending transversely of the panel construction 12 as well as a pair of laterally spaced apart parallel second slots 34 formed therein extending longitudinally of the panel construction 12. The slots 32 are spaced apart less than the spacing between the slots 34, the length of the slots 34 is greater than the spacing between the slots 32 and the slots 32 are disposed between the slots 34.

First and second elongated flexible straps 36 and 38 have their longitudinal mid-portions threaded through the slots 32 and 34 with the mid-portions overlap engaged with each other and disposed over the central area of the inner side 28 of the panel section 24.

The end margins of the panel sections 24 and 26 adjacent the end edges 18 and 20 include wide transversely extending slots 40 and 42 formed therein and which are registered with each other when the panel sections 24 and 26 are in their closed positions.

Figure 2:
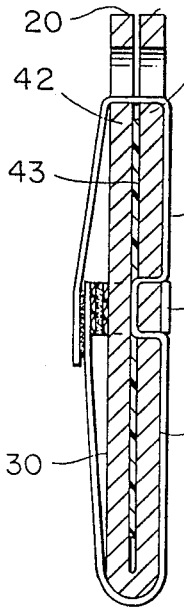
FIG. 2 is an enlarged vertical sectional view taken substantially upon the plane indicated by the section line 2—2 of FIG. 1.
Figure 4:
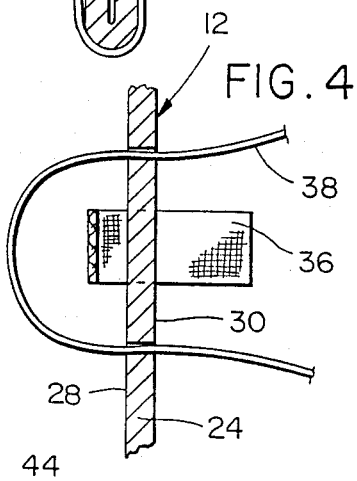
FIG. 4 is an enlarged fragmentary vertical sectional view taken substantially upon the plane indicated by the section line 4—4 of FIG. 3.

After one or more film sheets 43 have been disposed between the panel sections 24 and 26 and the latter are disposed in their closed positions, the straps or strap members may be passed and secured about the case 10. The opposite ends of the strap members 36 and 38 have coacting thistle fastener hook and loop strips 44 and 46 secured thereto on opposite sides of the straps 36 and 38 and the straps 36 and 38 are secured about the case 10 in the manner illustrated in FIG. 2 by the overlapped ends of each strap being releasably secured together by the corresponding strips 46 and 48. Of course, the straps 36 and 38 not only maintain the panel sections 24 and 26 of the panel construction 12 in the closed positions thereof, but also prevent one or more film sheets 43 from slipping out between the opposing inner surfaces 28 of the panel sections 24 and 26. In addition, the slots 40 and 42 may receive a person's fingers therethrough thereby enabling the case 10 to be conveniently carried.

By passing one free end of the strap 36 through the slots 40 and 42, the finger opening defined by the registered slots 40 and 42 remain unobstructed.

The foregoing is considered as illustrative of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is:

1. A case for containing hand-carrying panels to be protected during storage and transit, said case including an elongated panel construction incorporating opposite side longitudinal edges and opposite end transverse edges, said panel assembly including hinge defining means extending transversely thereof centrally immediate said opposite end edges and dividing said panel assembly into a pair of opposite end panel sections relatively angularly displaceable about said hinge defining means between substantially coplanar open positions and closely juxtaposed parallel closed positions with one pair of corresponding inner sides of said panel sections opposing each other and the other pair of corresponding outer sides of said panel sections facing outwardly of said case in opposite directions, one of said panel sections including a pair of first laterally spaced parallel slots formed therethrough, extending transversely of said panel assembly and centrally located on said one panel section, said one panel section also including a pair of second laterally spaced parallel slots formed therethrough, extending longitudinally of said panel assembly and centrally located on said one panel section, first and second strap means threaded through said first and second pair of slots, respectively, with longitudinal mid-portions of said first and second straps extending over the inner side of said one panel section between said first and second slots, said strap means each including end portions thereof projecting outwardly of the ends of said slots opening through the outer side of said one panel section, said end portions extending over the outer side of said one panel section away from remote sides of the corresponding slots, said end portions of said first and second strap means being of sufficient length to extend lengthwise and transversely of and about said panel assembly when said panel sections are in the closed position with the terminal ends of the end portions of each strap means overlap engaged with each other closely outward of the outer side of the other panel section, said terminal ends of each said strap means including coacting fastening means operative to releasably secure each pair of overlap engaged terminal ends together.

2. The case of claim 1 wherein said fastener means includes thistle-type fastener strips.

3. The case of claim 1 wherein each pair of overlap engaged terminal ends are centrally disposed over said other side of said other panel section.

4. The case of claim 3 wherein said fastener means includes thistle-type fastener strips.

5. The case of claim 1 wherein said panel sections, in the areas thereof closely adjacent and paralleling the end edges of said panel assembly, includes elongated transverse slots formed therein of a width to receive a person's fingers therethrough and registered with each other when said panel sections are in said closed position thereof.

6. The case of claim 5, wherein one of said end portions of said second strap means passes through the last mentioned slots.

7. The case of claim 6, wherein said fastener means includes thistle-type fastener strips.

8. The case of claim 7 wherein each pair of overlap engaged terminal ends are centrally disposed over said other side of said other panel section.

* * * * *